US006108977A

United States Patent [19]

Payne et al.

[11] Patent Number: 6,108,977

[45] Date of Patent: Aug. 29, 2000

[54] FOOT CLUTCH FOR AUTOMATIC GATE OPENER

[76] Inventors: Wayne Payne; Phil Wilkins, both of 3121 Hartsfield Rd., Tallahassee, Fla. 32303

[21] Appl. No.: 09/237,281

[22] Filed: Jan. 26, 1999

[51] Int. Cl.[7] ..... E05F 11/00

[52] U.S. Cl. ..... 49/360; 192/99 S; 49/263

[58] Field of Search ..... 49/263, 266, 273, 49/274, 360, 404; 192/99 S, 89.27

[56] References Cited

U.S. PATENT DOCUMENTS

| | | | |
|---|---|---|---|
| 952,535 | 3/1910 | Loomis | 192/89.27 X |
| 1,122,206 | 12/1914 | Jennings | 192/99 S X |
| 1,189,113 | 6/1916 | Ionides | 192/66.22 X |
| 2,668,914 | 2/1954 | Uher | 192/66.22 X |

FOREIGN PATENT DOCUMENTS

| | | | |
|---|---|---|---|
| 2449186 | 10/1980 | France | 49/360 |
| 4015448 | 11/1991 | Germany | 49/360 |

*Primary Examiner*—Jerry Redman
*Attorney, Agent, or Firm*—John Wiley Horton

[57] ABSTRACT

A device for engaging and disengaging the driving mechanism of an automatic slide gate. The device uses a series of two levers to develop a substantial mechanical advantage in the operation of a dog clutch. An actuating lever is positioned so that it may be operated by the user's foot, eliminating the need for any auxilliary levers or tools.

5 Claims, 7 Drawing Sheets

FOOT CLUTCH FOR AUTOMATIC GATE OPENER

BACKGROUND

1. Field of Invention

This invention relates to the field of automatic gate openers. More specifically, the invention comprises a mechanical clutch linkage which allows a user to disengage the drive mechanism of an automatic slide gate so that the gate may be opened manually.

2. Description of Prior Art

Numerous mechanisms have been patented for the operation of automatic gates. Examples are U.S. Pat. No. 5,720,132 to Renner et. al. (1998), U.S. Pat. No. 4,520,592 to Holloway (1985), and U.S. Pat. No. 4,416,085 to Lybecker et. al. (1983). Examples of patents more specifically addressing the operation of slide gates are U.S. Pat. No. 5,076,012 to Richmond et. al. (1991) and U.S. Pat. No. 4,791,757 to Orlando (1988).

Slide gates are typically used to secure parking lots for factories, offices, apartments, and the like. Security is often a prime concern. The main reason for installing a slide gate is to prevent access by unauthorized persons. Most slide gates used for these purposes are electrically operated. A competent design must therefore account for the possibility of power failure.

When the power fails, it must still be possible to open an electrically operated slide gate in order to account for emergency entrance and exit. Yet, since preventing unauthorized access to the secured area is the very reason for installing the gate to begin with, it must not be possible to open the gate from the outside simply by defeating the power supply. Various methods have been employed to address this problem. The invention described in '757 uses a release latch to disengage the driving chain from the sliding gate, identical to the release mechanism found on most overhead garage door openers. The release is triggered by a handle on the end of a short rope lanyard. Unfortunately, this method may easily be defeated by a thief reaching through the gate from the outside. Thus, it is not very secure.

A second approach is described in U.S. Pat. No. 5,076,012 to Richmond (199). The Richmond specification explains how most slide gate mechanisms use an electric motor delivering power through reduction gears. The final drive ratio is often as high as 100 to 1. If power is lost and an attempt is made to move the gate manually, the reduction gears are driven in reverse. There is therefore a very large resistance to moving the gate, and often the gate may not be moved at all. The Richmond invention addresses this recognized problem by placing a "freewheeling" or one-way clutch between the motor output and the gate drive mechanism. If torque is applied by the motor, this one-way clutch engages and transmits the torque to the gate driving mechanism. If, however, the gate is moved while the motor is stationary, the one-way clutch disengages and allows the gate to move without transferring torque to the motor. Thus, it is possible to move the gate without driving the motor.

One problem with the Richmond device is that the action of the one-way clutch renders the gate very easy to open from the outside. This problem is remedied through the use of an electrical sensing circuit and complex motor controls. If the device senses that the gate is in motion when there is no power driving the motor, then the device will energize the motor and apply a closing force to the gate. Of course, during a power failure the device is rendered completely inoperable. Thus, during a power failure, the gate may be easily pushed open. It is therefore possible to defeat the security of the Richmond device by cutting the power to the installation and pushing the gate open from the outside.

The known methods for driving the opening and closing of an automatic slide gate are therefore limited in that the security provided by the device may be defeated by either reaching through the gate to release the driving mechanism or cutting power to the installation.

OBJECTS AND ADVANTAGES

Accordingly, several objects and advantages of the present invention are:

(1) to allow an electrically operated slide gate to be moved manually in the event of a power failure;

(2) to maintain security by preventing access from persons outside the enclosed area in the event of a power failure;

(3) to employ a simple mechanical means for selectively engaging and disengaging the drive motor from the gate mechanism;

(4) to eliminate the need for complex sensing means and electrical control circuits in the engaging and disengaging of the drive motor;

(5) to provide an engaging and disengaging mechanism which is able to withstand extended service in harsh outdoor conditions; and (6) to provide a substantial mechanical advantage in the engaging and disengaging mechanism so that a powerful gate drive system may be engaged or disengaged without the use of auxiliary levers or tools.

DRAWING FIGURES

Figure 1:
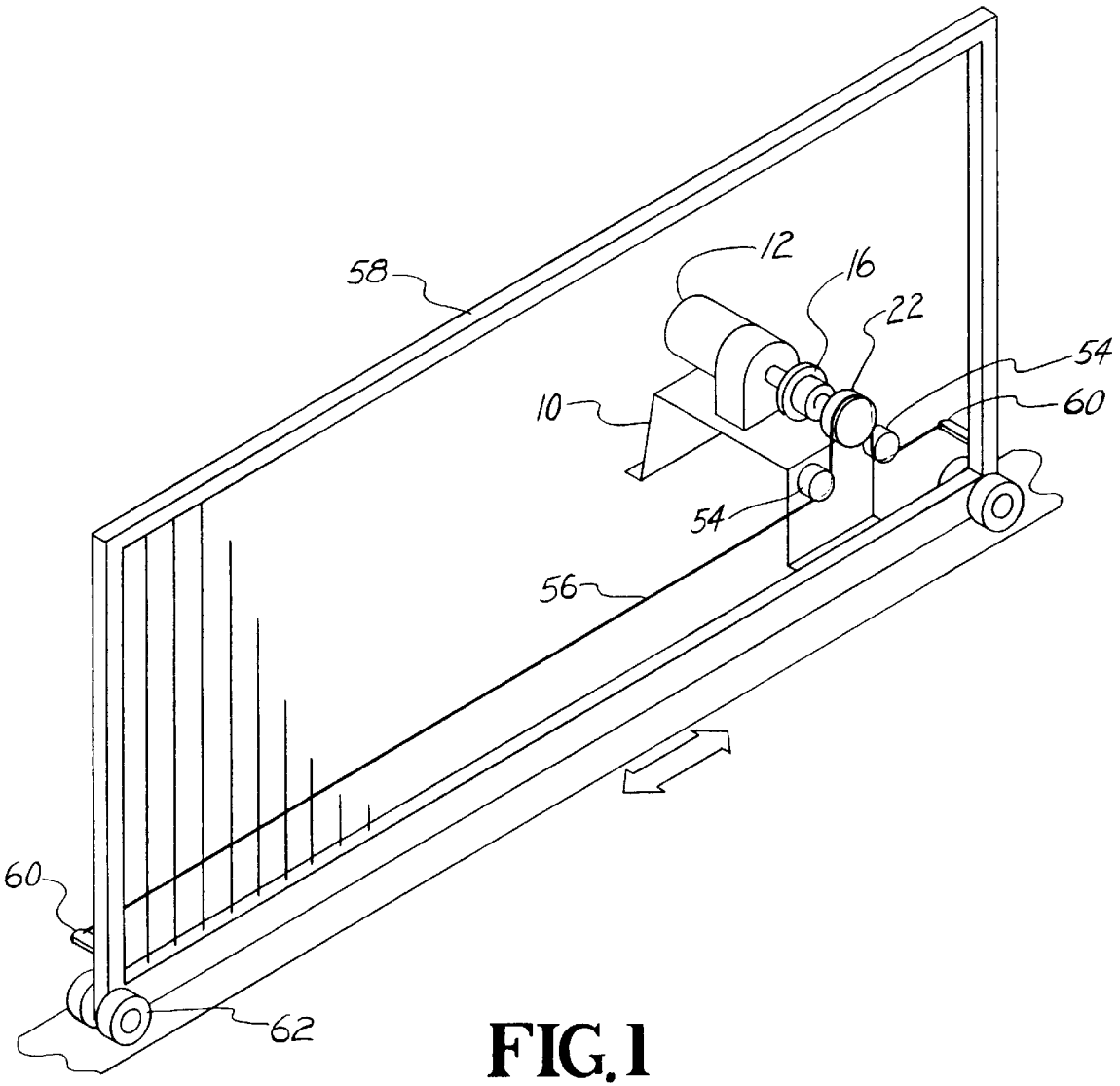
FIG. 1 is an isometric view, showing how the gate drive mechanism is coupled to an automatic slide gate.

| Reference Numerals in Drawings | |
|---|---|
| 10 | mount |
| 12 | gearmotor |
| 14 | motor shaft |
| 16 | dog clutch |
| 18 | dog clutch flange |
| 20 | drive sprocket shaft |
| 22 | drive sprocket |
| 24 | clutch spring |
| 26 | shift fork |
| 28 | fork lever |
| 30 | external bracket |

-continued

| Reference Numerals in Drawings | |
|---|---|
| 32 | front shift lever slot |
| 34 | lower fork lever pin |
| 36 | shift lever pin |
| 38 | internal bracket |
| 40 | upper fork lever pin |
| 42 | shift lever |
| 44 | rear shift lever slot |
| 46 | shift lock tab |
| 48 | return spring |
| 50 | handle portion |
| 52 | fork lever slot |
| 54 | idler sprocket |
| 56 | drive chain |
| 58 | gate |
| 60 | chain bracket |
| 62 | gate wheel |
| 64 | relief slot |
| 70 | camming slot |

Figure 2:
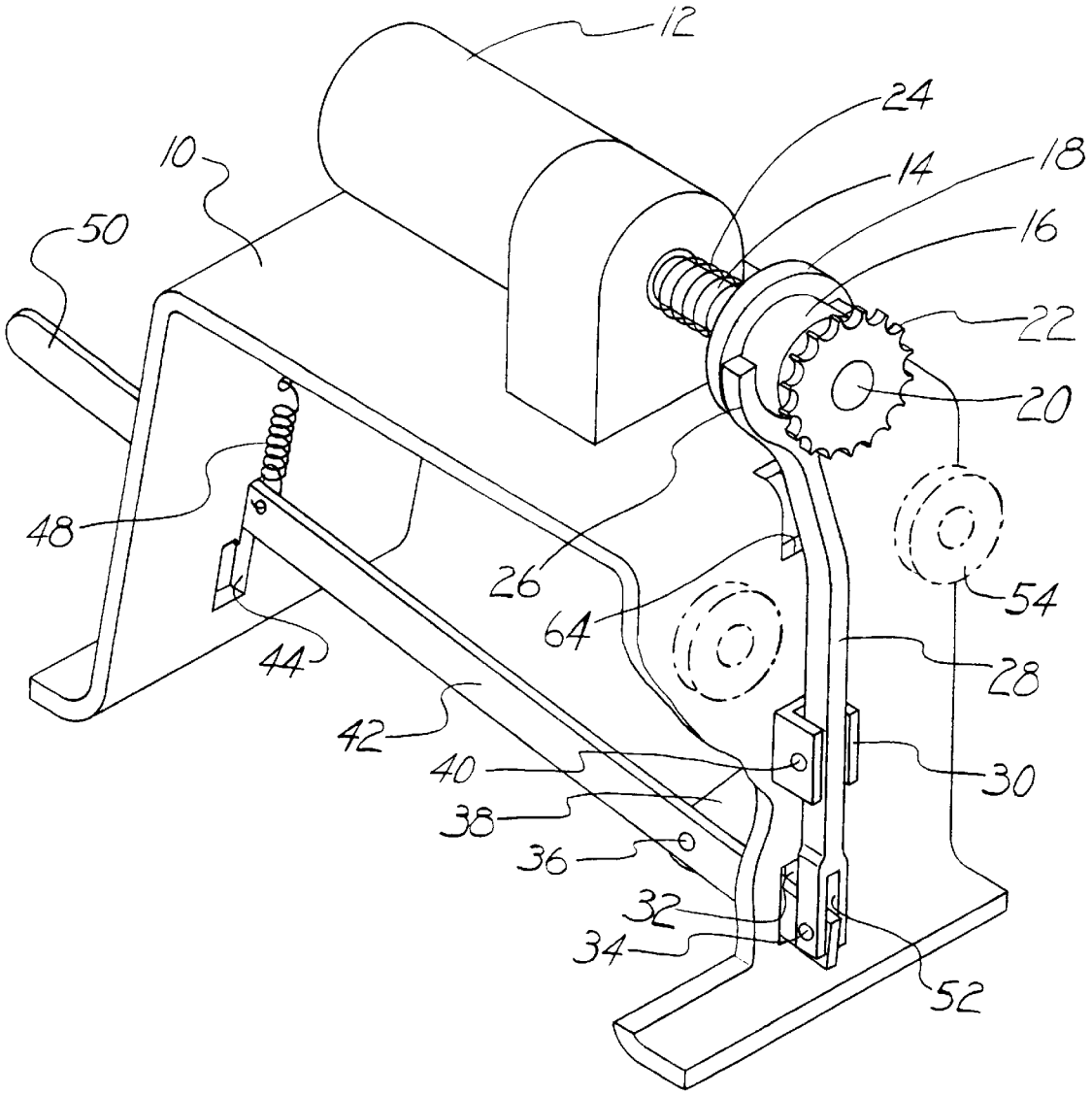
FIG. 2 is an isometric view, showing more detail of the proposed invention.
Figure 3:
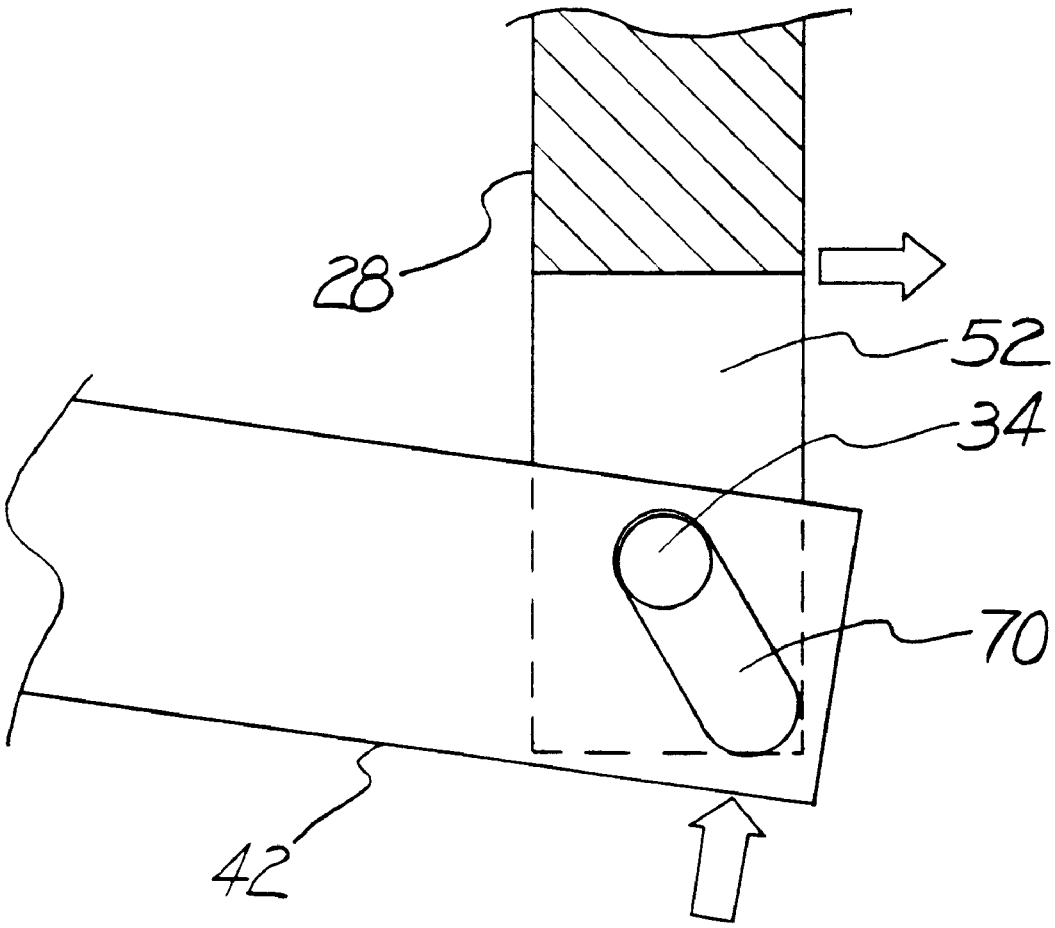
FIG. 3 is a sectional side elevation view, showing the interaction of two of the components illustrated in FIG. 2.

DESCRIPTION—FIGS. 1 through 3

The invention will be described, starting with FIG. 1. Gate 58 moves back and forth along the axis indicated by the arrow. Wheels 62 are provided to roll along the ground or a guiding track. Mount 10 is secured to the ground in close proximity to gate 58, roughly in the orientation shown. Mount 10 is generally located on the inside or secured side of gate 58. Gearmotor 12 is securely attached to the top of mount 10. Gearmotor 12 is of conventional design and incorporates an electric motor driving an output shaft through a set of reduction gears. Some detail of the driving mechanism has been omitted in FIG. 1 for purposes of simplicity. The omitted details will be illustrated and explained in later views.

Drive sprocket 22, positioned near the front of mount 10, is engaged and disengaged from gearmotor 12 via the operation of dog clutch 16. Chain 56, represented in the view by a solid line, is attached to gate 58 at each of the two chain brackets 60. Chain 56 passes around idler sprockets 54, which are mounted on the front of mount 10, and around drive sprocket 22 as shown. The reader will appreciate that chain 56 is composed of a series of links and that idler sprockets 54 and drive sprocket 22 have teeth configured to engage the links of chain 56 and thereby prevent any slipping. For purposes of simplicity, the links and engaging teeth have not been illustrated.

When gearmotor 12 turns and dog clutch 16 is engaged, drive sprocket 22 turns. The turning of drive sprocket 22 results in linear motion of chain 56, which moves gate 58 along the axis indicated by the arrow.

Turning now to FIG. 2, additional detail will be explained. Chain 56 is not shown in this view to prevent obstruction of other components. Likewise, sprockets 54 are only shown as ghost lines.

The output of gearmotor 12 is motor shaft 14. Attached to motor shaft 14 is dog clutch 16. Dog clutch 16 is provided for the purpose of engaging motor shaft 14 with drive sprocket shaft 20, or alternately disengaging motor shaft 14 from drive sprocket shaft 20. Drive sprocket 22 is rigidly attached to drive sprocket shaft 20. Dog clutch flange 18, which is an integral part of dog clutch 16, selectively engages and disengages dog clutch 16 when it is moved back and forth along the axis of motor shaft 14. Clutch spring 24 is provided to bias dog clutch 16 in the direction of drive sprocket 22, which is the engaged position.

Fork lever 28 is attached to the front of mount 10 by external bracket 30 and upper fork lever pin 40. At the upper end of fork lever 28 is shift fork 26, which is positioned to bear against dog clutch flange 18. At the lower end of fork lever 28 is fork lever slot 52, which allows the lower end of fork lever 28 to be slipped over the forward end of shift lever 42. Shift lever 42 is attached to fork lever 28 by lower fork lever pin 34, the operation of which will subsequently be described in greater detail. Relief slot 64 in mount 10 is provided to allow the upper portion of fork lever 28 to move rearward without striking mount 10.

Shift lever 42 is attached to mount 10 by internal bracket 38 and shift lever pin 36. Shift lever 42 passes through mount 10 at the forward end of mount 10 through front shift lever slot 32. Shift lever 42 passes through the rear of mount 10 through rear shift lever slot 44. Handle portion 50 of shift lever 42 extends out the rear of mount 10 for some distance as shown. Return spring 48 is provided to bias shift lever 42 upward.

Turning now to FIG. 3, the interaction of shift lever 42 and fork lever 28 will be explained. FIG. 3 shows a sectional view of fork lever 28, taken through fork lever slot 52. Shift lever 42 is shown without sectioning. At the forward end of shift lever 42 is camming slot 70. Camming slot 70 is tilted at an angle. Lower fork lever pin 34 is rigidly attached to fork lever 28. Lower fork lever pin 34 also passes through camming slot 70 of shift lever 42. Returning briefly to FIG. 2, the reader will appreciate that pushing down on handle portion 50 of shift lever 42, causes shift lever 42 to rotate about shift lever pin 36, which causes the forward portion of shift lever 42 to move upward.

Returning now to FIG. 3, this upward motion is illustrated by the arrow immediately below the forward portion of shift lever 42. As the forward portion of shift lever 42 moves upward, camming slot 70 forces lower fork lever pin 34 forward, which in turn forces the lower portion of fork lever 28 forward. This forward motion of fork lever 28 is shown by the second arrow moving horizontally. Thus, when a user presses down on handle portion 50, the lower portion of fork lever 28 is moved forward.

OPERATION—FIGS. 4 THROUGH 7

Figure 4:
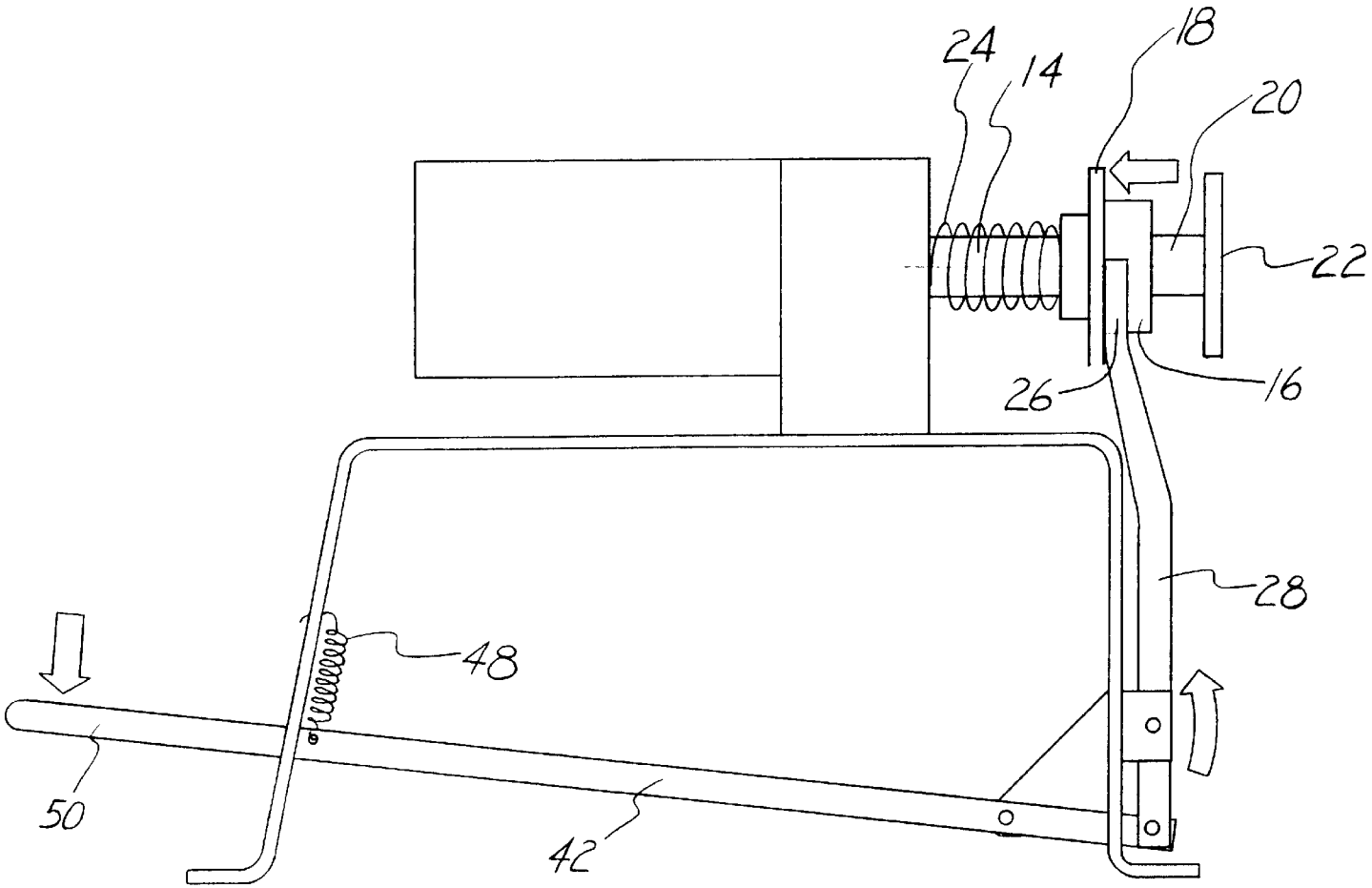
FIG. 4 is a side elevation view of the device shown in FIG. 2, showing the engaged position of the engaging/disengaging mechanism.

FIG. 4 shows a side elevation view of the invention. All the movable components are shown in their initial or rest condition. Dog clutch 16 is shown in its closest position to drive sprocket 22. In this state, dog clutch 16 locks drive sprocket shaft 20 to motor shaft 14. The output torque of gearmotor 12 is therefore transmitted through motor shaft 14, dog clutch 16, drive sprocket shaft 20, and then to drive sprocket 22.

Figure 5:
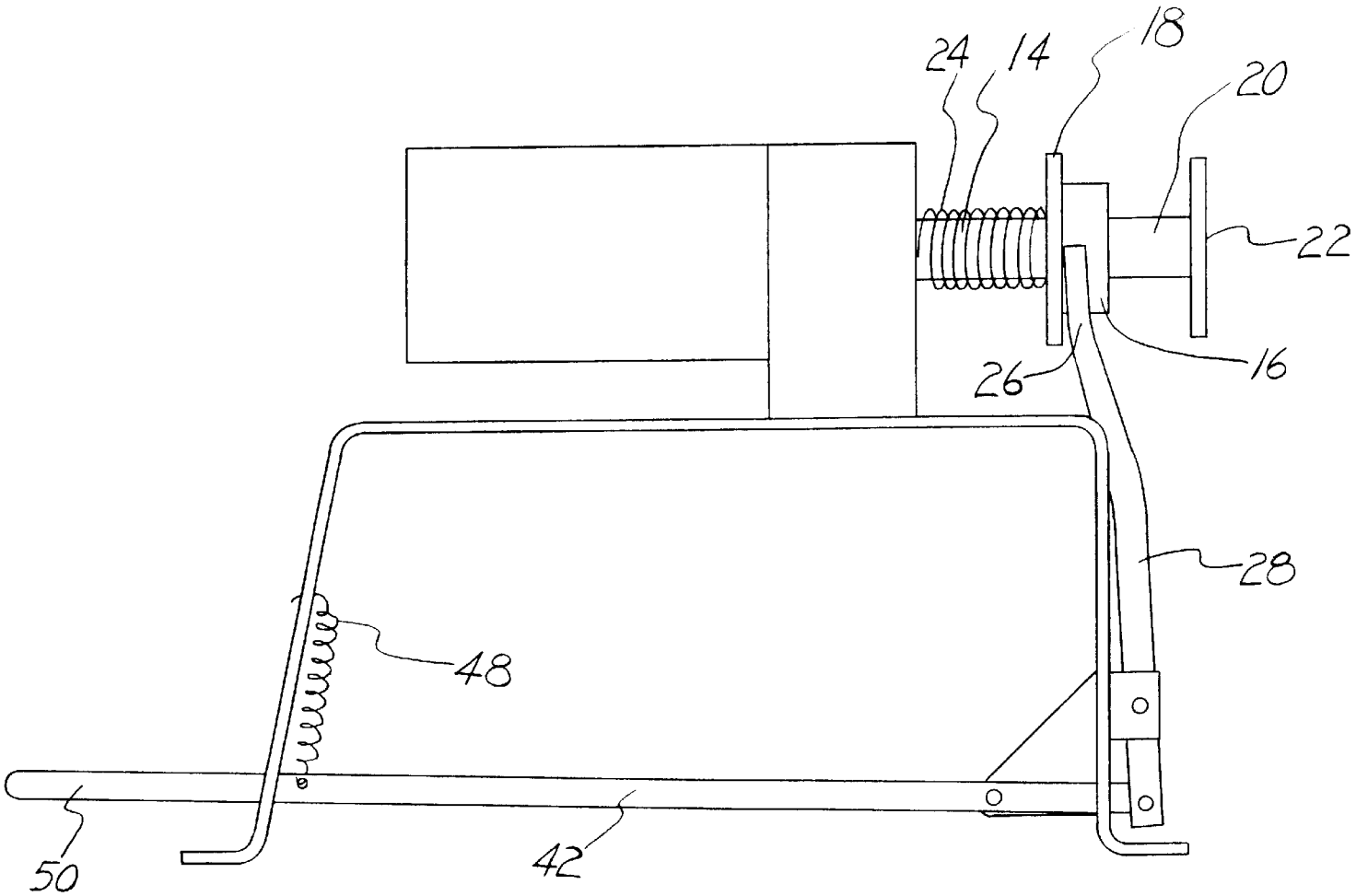
FIG. 5 is a side elevation view of the device shown in FIG. 2, showing the disengaged position of the engaging/disengaging mechanism.

In the state shown, gearmotor 12 is directly linked to drive chain 56 and gate 58. If the user wishes to grasp the gate and move it manually, he will have to overcome the inertial forces of gearmotor 12, including its reduction gear set. This will be very difficult. The principal object of the present invention is to allow the user to selectively uncouple gearmotor 12 from gate 58. FIGS. 4 and 5, taken together, illustrate how this is accomplished.

Starting with the state shown in FIG. 4, the user pushes down on handle portion 50 of shift lever 42. This force causes shift lever 42 to rotate counterclockwise about shift lever pin 36, resulting in the forward portion (or right hand portion as seen in FIG. 4) of shift lever 42 moving upward. As explained previously, the upward motion of the forward portion of shift lever 42 causes the lower portion of fork lever 28 to move forward. Fork lever 28 then rotates around upper fork lever pin 40, as shown by the curved arrow. The rotation of fork lever 28 causes shift fork 26 to move toward the rear (or left as depicted in FIG. 4) and apply pressure to dog clutch flange 18 of dog clutch 16.

As dog clutch 16 moves toward the rear, drive sprocket shaft 20 is disengaged from motor shaft 14. Turning now to FIG. 5, handle portion 50 of shift lever 42 is shown in the fully down position. Fork lever 28 has rotated counterclockwise to its maximum extent, and shift fork 26 has pushed dog clutch flange 18 as far toward the rear as it will go. At this point, drive sprocket shaft 20 is completely disengaged from motor shaft 14, and drive sprocket 22 may be rotated independently of gearmotor 12. Thus, in the state depicted in FIG. 5, it is possible for the user to manually grasp gate 58 and move it.

Figure 6:
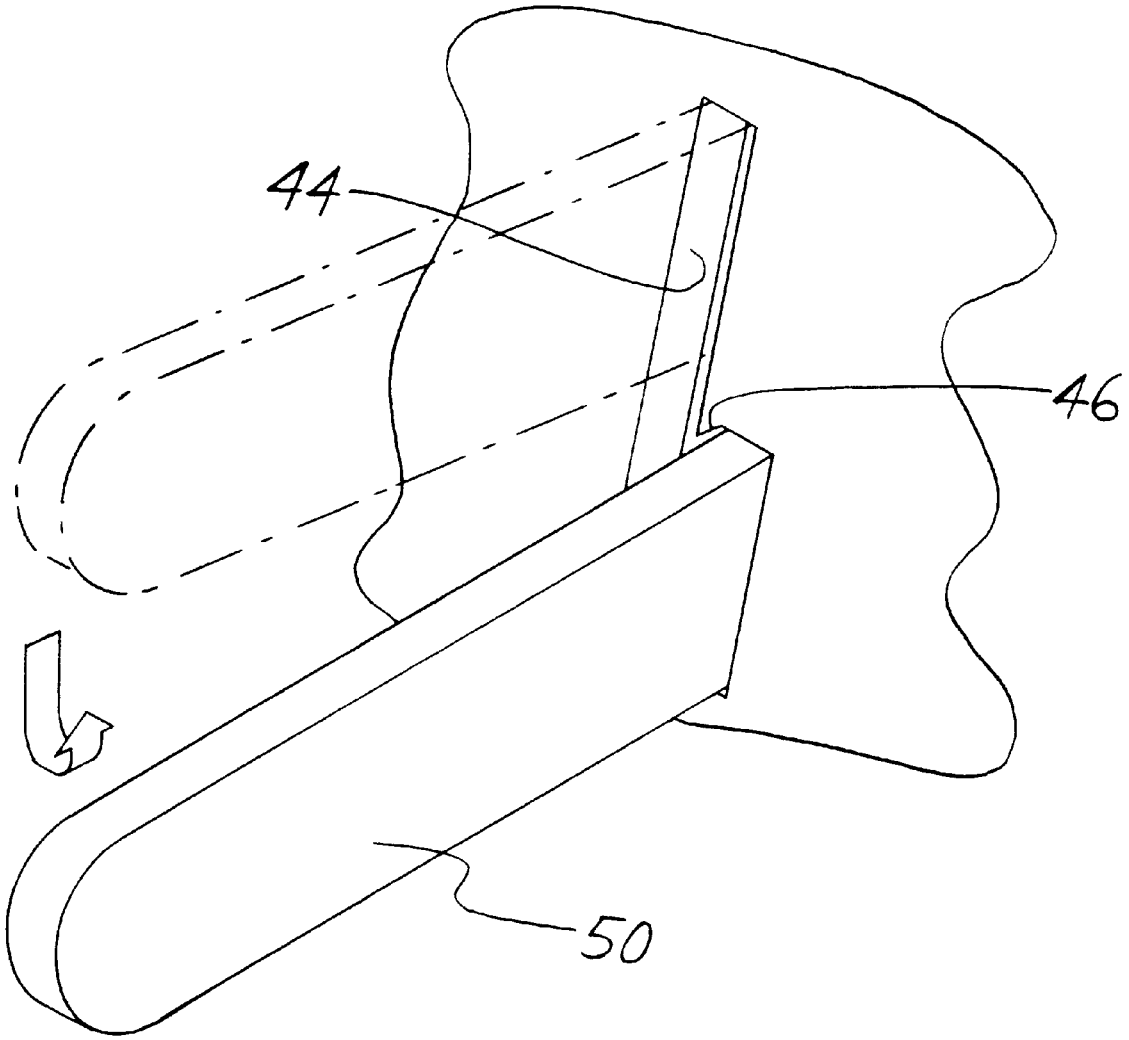
FIG. 6 is an isometric detail view.

Clutch spring 24 is provided to bias dog clutch 16 back toward the engaged position. Likewise, return spring 48 is provided to bias handle portion 50 of shift lever 42 back up toward its original position. Therefore, unless shift lever 42 is held down, gate 58 will again be coupled to gearmotor 12. It is impractical for a single operator to simultaneously maintain downward pressure on handle portion 50 and grasp and move the gate. A locking mechanism is therefore necessary. FIG. 6 details this locking mechanism.

FIG. 6 depicts a rear view of mount 10, showing details of rear shift lever slot 44. The lower section of rear shift lever slot 44 is wider than the upper section. The dashed lines represent the starting position of handle portion 50. As the user presses handle portion 50 down to the bottom of rear shift lever slot 44, it is possible to push handle portion 50 toward the right and into the wider section. If the user releases handle portion 50 while it is pushed over, return spring 48 (not shown in this view) will pull handle portion 50 upwards and handle portion 50 will be trapped by shift lock tab 46. Handle portion 50 will then remain locked in the position shown until the user pushes down on it again and moves it back to the left.

Figure 7:
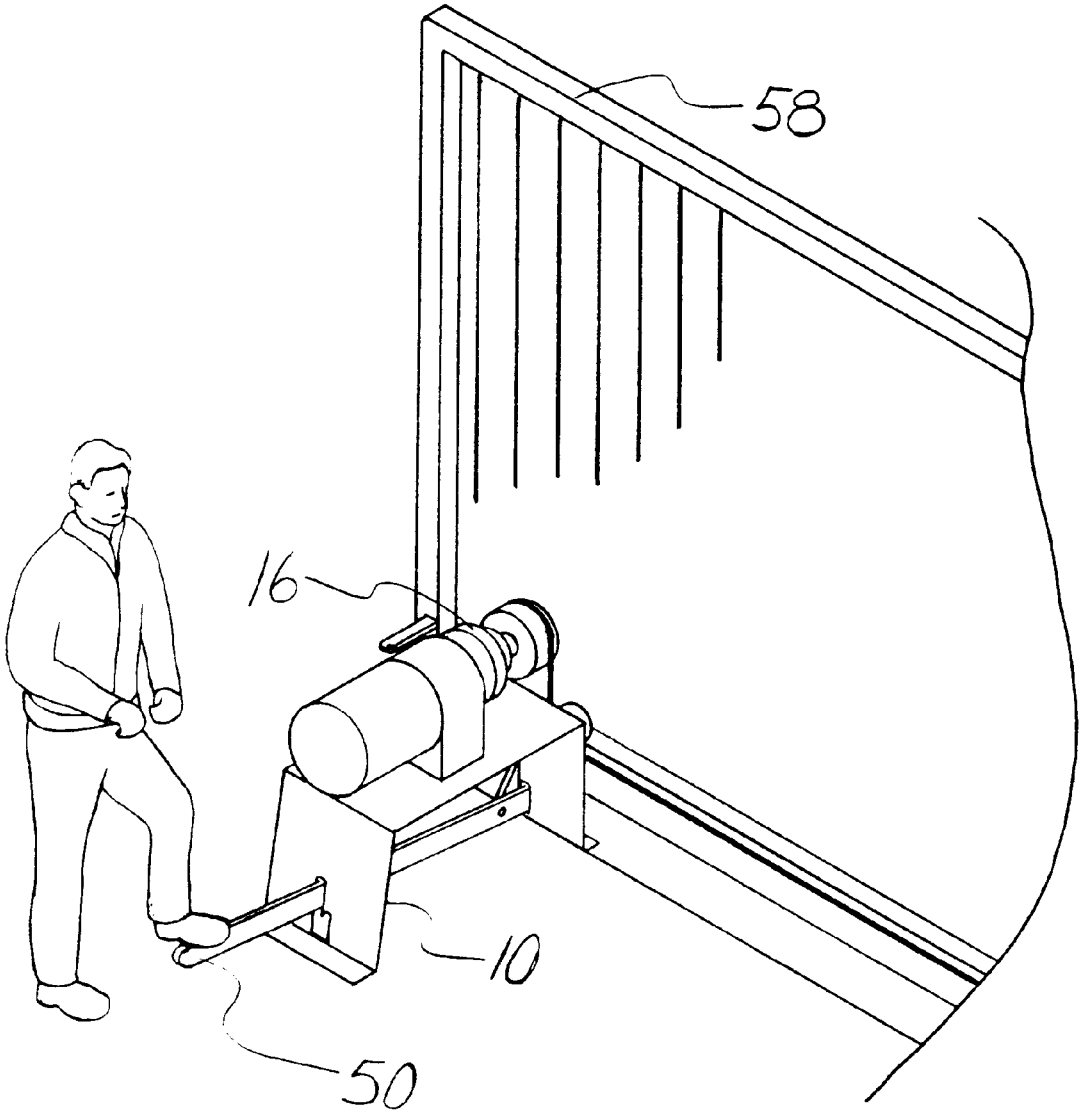
FIG. 7 is an isometric view, showing how a user operates the engaging/disengaging mechanism.

The reader will by now have a detailed understanding of the invention. However, it m ay be difficult to appreciate that very large drive mechanisms and clutches may be required to operate heavy industrial gates. It is therefore desirable to provide the operator with a convenient means of applying the force necessary to shift a large version of dog clutch 16. Turning to FIG. 7, this concept will be illustrated. The reader will appreciate that handle portion 50 may be made very long, thereby offering considerable mechanical advantage. The reader will also appreciate that handle portion 50 may be located close to ground level, so that the user may apply his foot as shown. The user may then employ his weight to overcome the inertial and spring forces of the large mechanism and easily disengage dog clutch 16.

Employing the invention thus described, it is possible for an operator on the inside or secured side of a sliding gate to disengage the gate from its driving mechanism and move it manually. It would, however, be very difficult for a person on the opposite side of gate 58 to do so. This is true because a substantial force must be applied to handle portion 50 in order to disengage dog clutch 16. Thus, an intruder trying to actuate handle portion 50 by the use of a pole or stick pushed through gate 58 would be unable to generate sufficient downward force.

SUMMARY, RAMIFICATIONS, AND SCOPE

Accordingly, the reader will appreciate that the proposed invention allows a motor driven sliding gate to be operated manually if need be. Furthermore, the proposed invention has additional advantages in that:

1. The sliding gate remains secure from the outside in the event of a power failure;
2. The disengaging mechanism may only be activated by persons on the inside of the secure area;
3. A large mechanical advantage is generated by the mechanism, allowing a single operator to engage and disengage a large gate drive mechanism without external levers or tools; and
4. The actuating portion of the mechanism may be located near the ground so that an operator may use body weight, transmitted through his or her foot, to engage or disengage the drive.

Although the preceding description contains significant detail, it should not be construed as limiting the scope of the invention but rather as providing illustrations of the preferred embodiment of the invention. For example, many types of drive mechanisms could be substituted for gearmotor 12, handle portion 50 could be flattened to encompass a foot pedal, etc. Thus, the scope of the invention should be fixed by the following claims, rather than by the examples given.

Having described our invention, we claim:

1. A device allowing a user to selectively engage and disengage an electric motor of an automatic slide gate, comprising:

a. a mount, anchored to the ground;

b. said electric motor, attached to said mount, with said electric motor transmitting torque through a motor shaft;

c. a drive sprocket shaft, lying along the same axis as said motor shaft but not being connected thereto;

d. a dog clutch, attached to said motor shaft, with said dog clutch being capable of moving from an engaged position, in which said dog clutch locks said drive sprocket shaft to said motor shaft, to a disengaged position, in which said drive sprocket shaft is not locked to said motor shaft; and e. actuation means, whereby said user may selectively move said dog clutch between said engaged position and said disengaged position, comprising a handle portion, with said handle portion being positioned near the ground, and being in a substantially horizontal orientation, so that said user may apply a force to said handle portion by stepping down on it.

2. A device as recited in claim 1, wherein said actuation means comprises:

a. a dog clutch flange, formed integrally with said dog clutch and extending outward from the perimeter of said dog clutch;

b. a fork lever, having an upper portion and a lower portion, rotatably attached to said mount, with said upper portion of said fork lever forming a shift fork, with said shift fork being positioned to bear against said dog clutch flange;

c. a handle portion being positioned near the ground, and being in a substantially horizontal orientation, so that said user may apply a force to said handle portion by stepping down on it, with said handle portion being movably attached to said lower portion of said fork lever in such a fashion that as said user applies said force to said handle portion said shift fork is forced against said dog clutch flange, thereby moving said dog clutch to said disengaged position; and d. a clutch spring, positioned to bias said dog clutch toward said engaged position, so that when said shift fork no longer bears against said dog clutch flange, said dog clutch returns to said engaged position.

3. A device allowing a user to selectively engage and disengage an electric motor of an automatic slide gate, comprising:

a. a mount, anchored to the ground;

b. said electric motor, attached to said mount, with said electric motor transmitting torque through a motor shaft c. a drive sprocket shaft, lying along the same axis as said motor shaft but not being connected thereto;

d. a dog clutch, attached to said motor shaft, with said dog clutch being capable of moving from an engaged position, in which said dog clutch locks said drive sprocket shaft to said motor shaft, to a disengaed position, in which said drive sprocket shaft is not locked to said motor shaft;

e. a dog clutch flange, formed integrally with said dog clutch and extending outward from the perimeter of said dog clutch;

f. a fork lever, having an upper portion and a lower portion, rotatably attached to said mount, with said upper portion forming a shift fork, with said shift fork being positioned to bear against said dog clutch flange;

g. a shift lever, having a handle portion and a forward portion, rotatably attached to said frame, including a camming slot within its forward portion, and positioned so that said forward portion of said shift lever rests within a fork lever slot in said lower portion of said fork lever; and h. a lower fork lever pin, which passes through said camming slot in said shift lever, and which is fixedly attached to said lower portion of said fork lever across said fork lever slot, so that when said shift lever is rotated, the camming action of said camming slot against said lower fork lever pin causes said fork lever to rotate in the same direction.

4. A device as recited in claim 3, wherein said handle portion extends well beyond said mount, with said handle portion being positioned near the ground so that said user may apply force to said handle portion by stepping on it.

5. A device as recited in claim 4, wherein said mount further comprises a rear shift lever slot, sized to allow said shift lever to pass through said mount and incorporating a shift lock tab in order to lock said handle portion of said shift lever at the lowest extent of its travel.

* * * * *